United States Patent [19]

Edmonds et al.

[11] Patent Number: 4,989,907

[45] Date of Patent: Feb. 5, 1991

[54] PADDLE HANDLE LATCH

[75] Inventors: Michael Edmonds, Columbia, S.C.; David Perotto, Kenosha, Wis.; Kenneth Cain, West Columbia, S.C.

[73] Assignee: Versch Lock Mfg. Co., Inc., Columbia, S.C.

[21] Appl. No.: 344,251

[22] Filed: Apr. 27, 1989

[51] Int. Cl.[5] ..... E05C 3/08

[52] U.S. Cl. ..... 292/223; 292/207; 292/DIG. 31; 292/DIG. 55

[58] Field of Search ..... 292/207, 337, 221, 223, 292/304, DIG. 31, DIG. 39, DIG. 40, DIG. 55, DIG. 62

[56] References Cited

U.S. PATENT DOCUMENTS

| | | | |
|---|---|---|---|
| 1,882,248 | 10/1932 | Madsen | 292/221 |
| 2,209,886 | 7/1940 | Hill | 292/221 |
| 2,243,772 | 5/1941 | Peltier | 292/221 X |
| 2,317,700 | 4/1943 | Thompson | 292/DIG. 31 X |
| 2,497,797 | 4/1947 | Rogers | 9/1 |
| 2,534,693 | 3/1947 | Adams | 292/223 |
| 3,668,907 | 6/1972 | Pastva, Jr. | 70/153 |
| 3,698,215 | 10/1972 | Truhon | 70/152 |
| 3,707,862 | 1/1973 | Pastva, Jr. | 70/150 |
| 3,817,064 | 6/1974 | Sallee | 70/58 |
| 3,918,278 | 11/1975 | Spear | 70/58 |
| 4,069,691 | 12/1978 | Simpson | 70/59 |
| 4,280,725 | 7/1981 | Berkowitz et al. | 292/DIG. 71 |
| 4,291,557 | 9/1981 | Bulle et al. | 70/58 |
| 4,420,954 | 12/1983 | Hieronymi et al. | 70/150 |
| 4,613,176 | 9/1986 | Kelly | 292/DIG. 55 |

*Primary Examiner*—Richard E. Moore

*Attorney, Agent, or Firm*—Willian Brinks Olds Hofer Gilson & Lione

[57] ABSTRACT

A paddle handle latch includes a frame which defines a recess, and a peripheral handle which is mounted for pivotal movement in the recess. A retainer is mounted to the frame to define a channel having a latching axis and this retainer is shaped to receive a striker moving along the latching axis and to retain the striker against movement transverse to the latching axis. A catch is pivotably mounted in the retainer to move between an open position and a closed position. A linkage interconnects the paddle handle and the catch such that the paddle handle operates to move the catch between the open and closed positions.

18 Claims, 4 Drawing Sheets

PADDLE HANDLE LATCH

BACKGROUND OF THE INVENTION

One well known type of latch or lock includes a paddle handle that is pivotably mounted to a frame to operate the latch mechanism The inventors are aware that such paddle handle locks have been used in the past with bolts (Hieronymi U.S. Pat. No. 4,420,954) slam latches (Adams U.S. Pat. No. 2,534,693), and rotary latching mechanisms. These and other similar paddle handle latches and locks have achieved widespread use in a variety of applications.

Nevertheless, the need exists for an improved paddle handle latch or lock that is easy to close and that positively locates the striker once the striker is engaged with the latch.

SUMMARY OF THE INVENTION

According to this invention a paddle handle latch is provided which comprises a frame having a perimeter flange and defines a recess internal of the flange. A paddle handle is mounted to the frame for pivotal movement in the recess, and means are provided for mounting the flange to a support panel. A retainer is mounted to define a channel having a latching axis. This retainer is shaped to receive a striker moving along the latching axis and to retain the striker against movement transverse to the latching axis. A catch is mounted in the retainer to move between an open position, in which the catch allows the striker to move along the latching axis in and out of the channel, and a closed position, in which the catch prevents the striker from moving along the latching axis out of the channel. A linkage interconnects the paddle handle and the catch so that the paddle handle operates to move the catch from the open position to the closed position.

The preferred embodiments described below are particularly easy to operate The catch is shaped to allow the striker to easily move the catch aside as the striker moves into engagement with the catch. The catch cooperates with the channel defining retainer to locate the striker positively. This provides a positive lock which is strong and pry resistant. The latch described below is well suited for a variety of storage compartments in vehicles, as well as in other applications.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
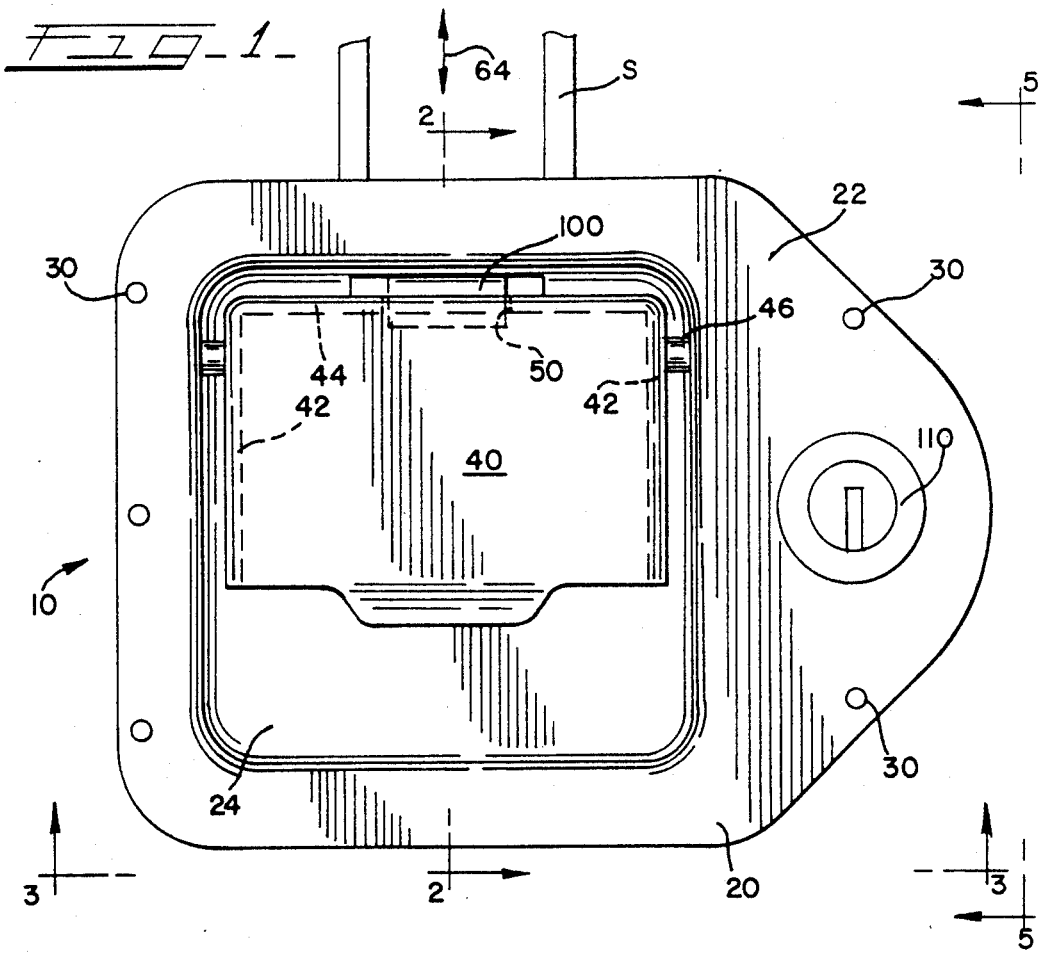
FIG. 1 is a front view of a first preferred embodiment of the latch of this invention.

Turning now to the drawings, FIG. 1 shows a front view of paddle handle latch 10 which incorporates a first preferred embodiment of this invention. The latch 10 is used with a striker S mounted to move along a latching axis 64. For example, the paddle handle latch 10 can be mounted to a wall of a container and the striker S can be mounted to a hinged lid of the container.

The latch 10 includes a frame 20 which in this embodiment is preferably a one piece metal stamping. The frame 20 includes a peripheral flange 22 which is planar A recess 24 is stamped into the interior of the frame 20 such that the recess 24 is surrounded by the flange 22. The bottom of the recess 24 defines a dimple 26 used to retain a spring as defined below. One sidewall of the recess 24 defines an opening 28 as best shown in FIG. 3, and the flange 22 defines a number of mounting openings 30 as best shown in FIG. 1.

Figure 2:
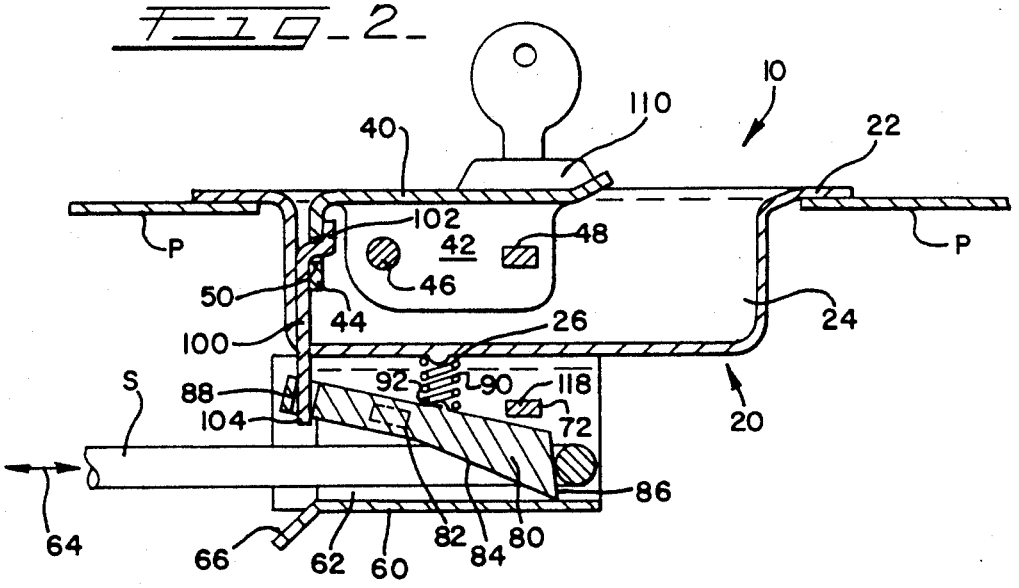
FIG. 2 is a cross-sectional view taken along line 2—2 of FIG. 1.
Figure 3:
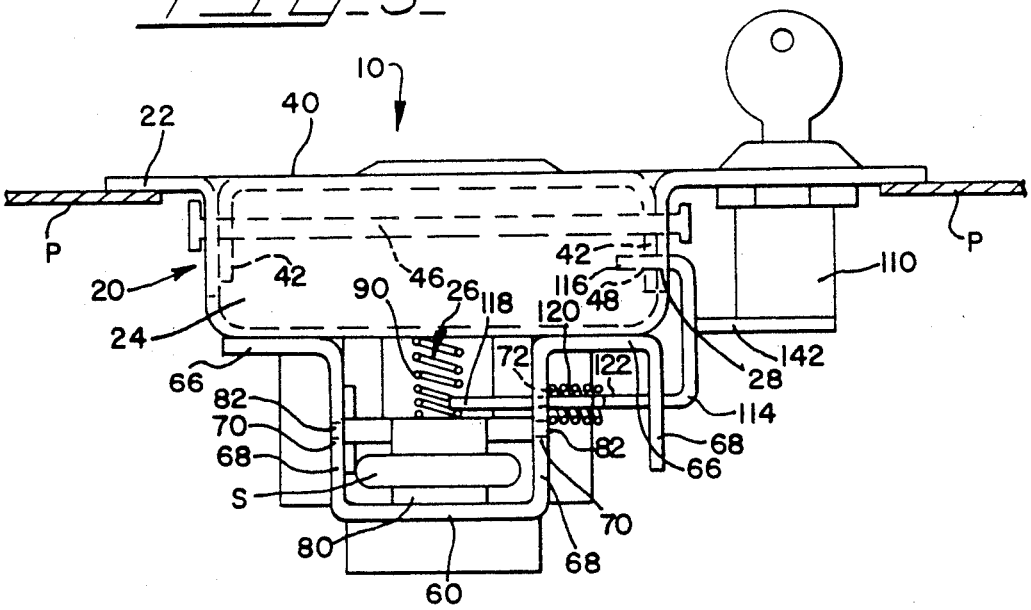
FIG. 3 is a side view taken along line 3—3 of FIG. 1.
Figure 4:
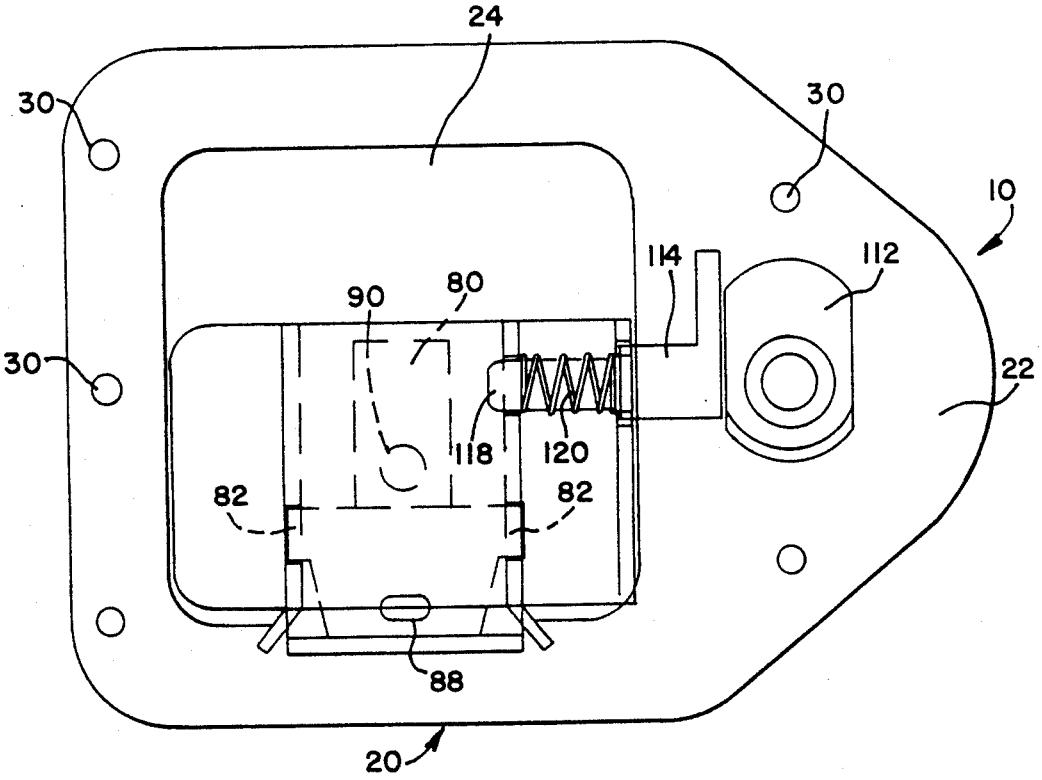
FIG. 4 is a rear view of the latch of FIG. 1.
Figure 5:
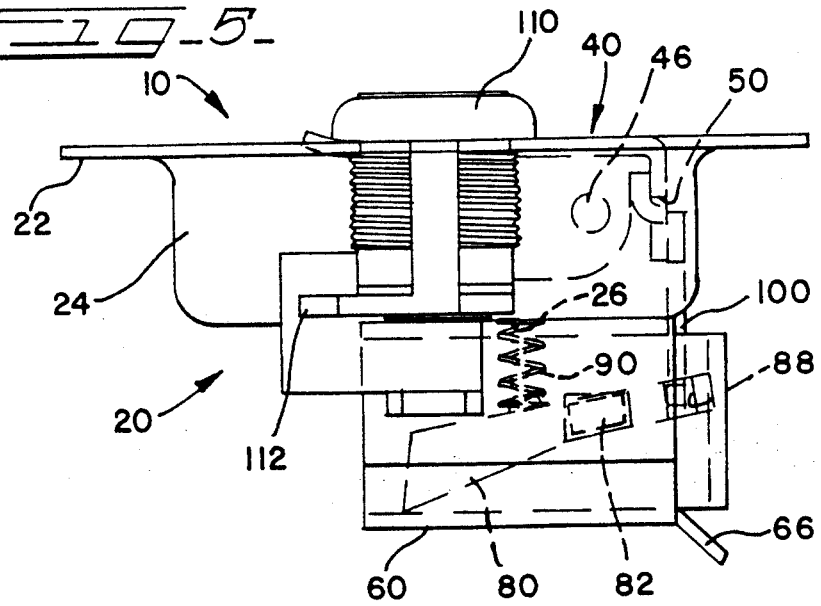
FIG. 5 is an end view taken along line 5—5 of FIG. 1.

As best shown in FIGS. 1, 2 and 3, a paddle handle 40 is pivotably mounted within the recess 24. This paddle handle 40 is in this embodiment preferably stamped from a single sheet of metal and defines two side flanges 42 and a rear flange 44. A pivot 46 passes through aligned openings in the side flanges 42 and the frame 20 and defines a pivot axis for the paddle handle 40. As shown in FIG. 3, one of the side flanges 42 defines a side opening 48. As best shown in FIG. 2 the rear flange 44 defines a rear opening 50.

As best shown in FIGS. 2 and 3, a retainer 60 is secured to the underside of the frame 20, as for example by spot welding. This retainer 60 defines a channel 62 that is bounded on three sides by the retainer 60. This channel 62 is oriented parallel to the latching axis 64 of FIGS. 1 and 2. One end of the channel 62 is flared outwardly to define an enlarged entrance region 66. As best shown in FIG. 3 the retainer 60 is in this embodiment preferably stamped from a single sheet of metal and defines two base plates 66 which are in contact with and secured to the underside of the frame 60. Three upright panels 68 extend from the base plates 66, and these upright panels 68 define openings 70, 72 (FIG. 3).

A catch 80 is pivotably mounted in the openings 70 within the channel 62 defined by the retainer 60. The catch 80 includes spaced colinear pivots 82 which are shaped somewhat smaller than the respective openings 70 so as to allow pivotal movement of the catch 80. As best shown in FIG. 2 the catch 80 defines a sloping face 84 and a transverse face 86. The sloping face 84 is positioned to engage the striker S as it moves into the latch such that the striker S can push the catch 80 upwardly out of the channel 62. When the striker S passes beyond the catch 80 a spring 90 interposed between the catch 80 and the underside of the frame 20 biases the catch 80 to the closed position shown in FIG. 2, in which the transverse face 86 contacts the striker S and prevents it from moving out of the channel 62 along the latching axis 64. The other end of the catch 80 defines an opening 88 as shown in FIG. 2. The spring 90 is retained by aligned dimples 26, 92 on the frame 20 and catch 80, respectively.

As best shown in FIGS. 1 and 2, a strut 100 is interposed between the rear flange 44 of the paddle handle 40 and the catch 80. The strut 100 has an upper end 102 that defines an S-shape bend where it passes through the rear opening 50. The strut 100 defines a lower end 104 which forms a narrowed pin that fits within the opening 88 in the catch 80. As shown in FIG. 2 the strut 100 passes through an opening in the bottom of the frame 20 and is mounted for axial movement.

When the latch 10 is in its rest position the spring 90 biases the catch 80 to the closed position shown in FIG. 2, and the catch 80 pushes the strut 100 upwardly, thereby biasing the paddle handle 40 to the closed position shown in FIG. 2. If in this position the striker S is moved into the channel 62 along the latching axis 64, the front of the striker S contacts the sloping face 84 and pushes the catch 80 out of the channel 62. The lower end 104 of the strut 100 fits loosely within the opening 88, and the catch 80 is free to move to allow the striker S to move to the latching position shown in FIG. 2 without movement of the paddle handle 40. When it is desired to release the striker S the paddle handle 40 is manually rotated about the pivot 46. This causes the strut 100 to move axially toward the striker S, thereby pivoting the catch 80 to the open position, in which the catch 80 is positioned out of the channel 62 and the striker S is released.

A lock cylinder 110 is mounted at an end portion of the peripheral flange 22. This lock cylinder 110 includes a lock plate 112 (FIG. 3) which bears against a lock bar 114. The lock bar 114 is guided for sliding movement and includes a first end 116 and a second end 118. The first end 116 is aligned with the openings 28, 48 in the frame 20 and side flange 42. The second end 118 passes through the opening 72 and is positioned between the catch 80 and the frame 20. FIG. 3 shows the lock bar 114 in the locked position in which the first end 116 securely locks the paddle handle 40 in position in the recess 24, and the second end 118 prevents the catch 80 from pivoting to the open position out of the channel 62. When the lock plate 112 is rotated to the unlocked position by the lock cylinder 110, a spring 120 acting between the retainer 60 and a shoulder 122 on the lock bar 114 biases the lock bar 114 to the right as shown in FIG. 3, thereby disengaging the lock bar 114 both from the paddle handle 40 and the catch 80. In this way normal operation of the paddle handle latch 10 is enabled.

Figure 6:
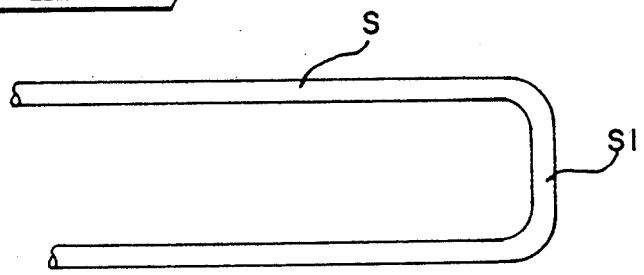
FIG. 6 is a plan view of the striker shown in FIG. 1.
Figure 7:
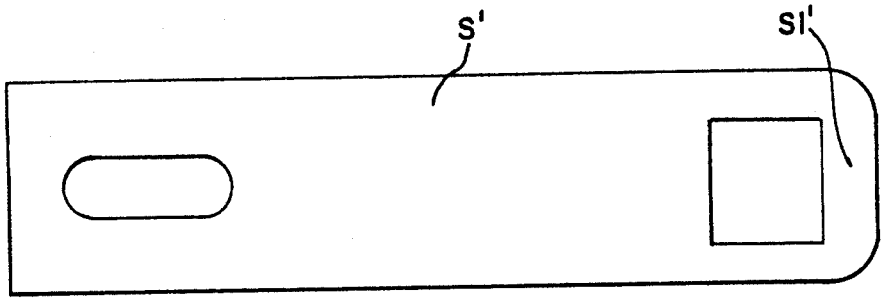
FIG. 7 is a plan view of an alternative striker suitable for use with the latch of FIG. 1

FIG. 6 shows a plan view of the striker S which includes a cross bar S1 that is positioned to engage the transverse face 86 of the catch 80. FIG. 7 shows a plan view of an alternate striker S′ which is a thin plate having an opening at one end that defines the cross bar S1′ Both designs are suitable for use with the embodiment of FIG. 1.

Figure 8:
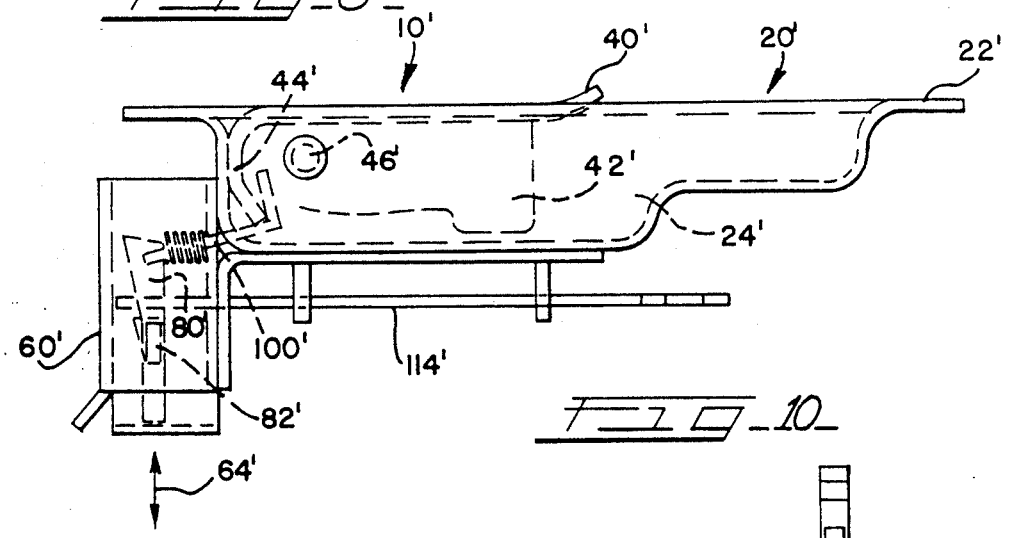
FIG. 8 is a side view of a second preferred embodiment of the latch of this embodiment.
Figure 9:
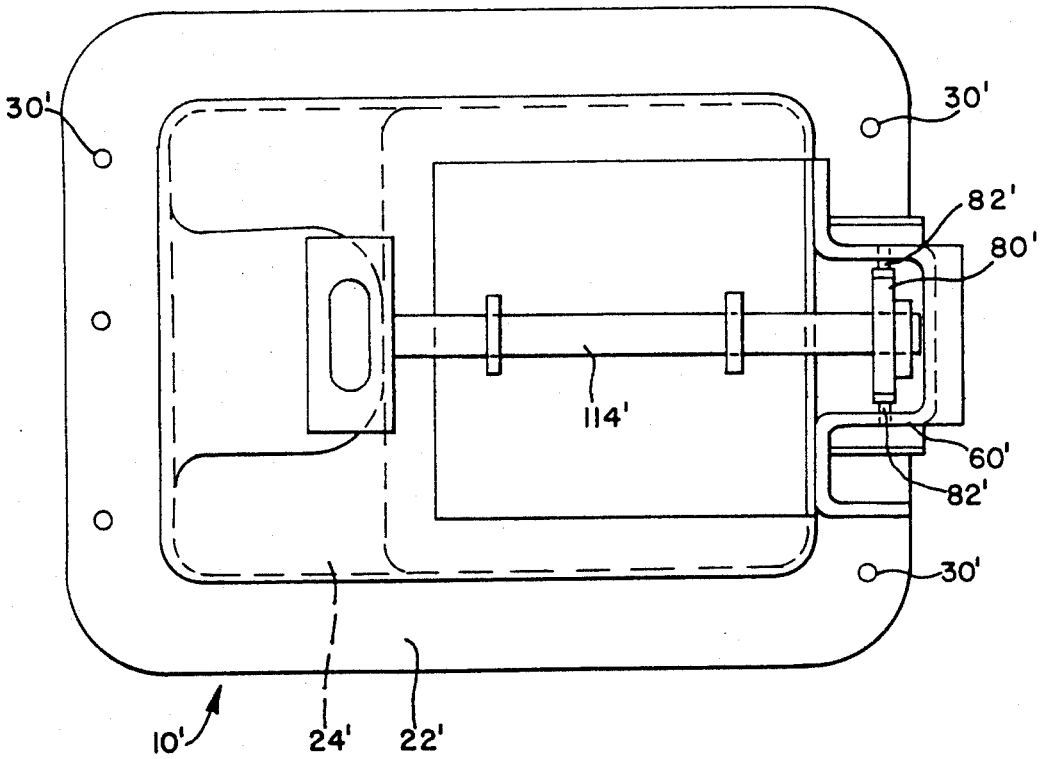
FIG. 9 is a rear view of the latch of FIG. 8.

FIGS. 8 and 9 show side and rear views, respectively, of a second preferred embodiment. In this second preferred embodiment corresponding elements have been given corresponding numbers, with the addition of a prime. The primary difference between the latch 10′ of FIGS. 8 and 9 and the latch 10 described above is that in this case the latching axis 64′ is rotated by 90 degrees with respect to the latching axis 64. The strut 100′ is modified to accommodate this revised geometry, and the retainer 60′ is mounted on the side rather than the bottom of the recess 24′. In addition, the lock bar 114′ is modified so as to pass through the catch 80′ and the striker into an opening in the retainer 60′ In this way the striker is captured independently of the catch 80′ and the paddle handle 40′ and catch 80′ can be moved freely without releasing the striker from the lock bar 114′.

Typically, the latches 10, 10′ will in use be mounted to a panel P as shown in FIGS. 2 and 3. The panel P is arranged generally parallel to the peripheral flange 22. A wide variety of means can be provided for mounting the frame 20 on the panel P, such as threaded or riveted fasteners, spot welds, mounting clips, or the like. Furthermore, if desired, the catch can be arranged so that it can be actuated from both sides of the panel.

A wide variety materials, dimensions and fabrication techniques can be used for the embodiments described above. In one presently preferred version of these embodiments the catches 80, 80′ are formed of powdered metal, and the remaining structural parts are formed of plated cold rolled steel. Of course, a wide variety of other materials can be used such as stainless steel, die cast metals or plastics.

Figure 10:
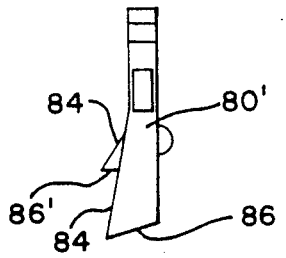
FIG. 10 is a side view of an alternate catch.

Of course, it should be understood that a wide range of changes and modifications can be made to the preferred embodiments described above. For example, the catch 80, 80′ can be modified to provide multiple, axially offset transverse faces that provide primary and secondary latching positions FIG. 10 shows a view of a modified catch 80″ which provides this function A striker with multiple openings can be used to provide a similar function. It is therefore intended that the foregoing detailed description be regarded as illustrative rather than limiting, and that it be understood that it is the following claims, including all equivalents, which are intended to define the scope of this invention.

We claim:

1. A paddle handle latch/striker assembly comprising:

a frame having a perimeter flange and defining a recess internal of the flange;

a paddle handle received in the recess and mounted to the frame for pivotal movement in the recess;

means for mounting the flange to a first support element;

a striker mounted to a second support element for movement along a latching axis relative to the frame;

a retainer mounted to define a channel aligned with the latching axis, said retainer shaped to receive the striker moving along the latching axis and to retain the striker against movement transverse to the latching axis;

a catch mounted in the retainer to move between an open position, in which the catch allows the striker to move along the latching axis in and out of the channel, and a closed position, in which the catch prevents the striker from moving along the latching axis out of the channel; and a linkage interconnecting the paddle handle and the catch such that the paddle handle operates to move the catch from the closed position to the open position.

2. The invention of claim 1 further comprising a lock means mounted on the frame for selectively locking the catch in the closed position.

3. The invention of claim 2 wherein the lock means comprises a lock cylinder and a lock bar positioned by the lock cylinder, said lock bar positionable to lock the catch in the closed position.

4. The invention of claim 1 wherein the linkage comprises a strut mounted for axial movement in the frame and mounted at one end on the paddle handle and at the other end on the catch.

5. The invention of claim 4 wherein the strut is movable in the catch such that the catch can move from the closed to the open position without axially shifting the strut in the frame.

6. The invention of claim 5 wherein the catch presents a first, sloping face to the striker as the striker enters the channel such that the striker pushes the catch aside as the striker enters the channel, and the catch presents a second, transverse face to the striker as the striker moves out of the channel.

7. The invention of claim 1 further comprising a spring interposed between the frame and the catch to bias the catch to the closed position.

8. The invention of claim 6 further comprising a spring interposed between the frame and the catch to bias the catch to the closed position.

9. The invention of claim 1 wherein the channel has an enlarged entrance region to facilitate alignment and entry of the striker into the channel.

10. The invention of claim 6 wherein the transverse face comprises two face portions axially offset along the latching axis to provide primary and secondary latching positions.

11. The invention of claim 1 further comprising a lock bar positioned to be movable in the retainer between a locked position, in which the lock bar passes through the striker, and an unlocked postion, in which the lock bar is removed from the channel.

12. A paddle handle latch configured for use with a striker mounted for movement toward and away from the latch along an opening/closing axis, said latch comprising:

a frame having a perimeter flange and defining a recess internal of the flange;

a paddle handle mounted to the frame for pivotal movement in the recess;

means for mounting the flange to a support panel;

a retainer mounted to define a channel having a latching axis, said retainer shaped to receive the striker when the latching axis is aligned with the opening/closing axis, and said retainer shaped to retain the striker against movement transverse to the latching axis;

a catch mounted in the retainer to move between an open position, in which the catch allows the striker to move along the latching axis in and out of the channel, and a closed position, in which the catch prevents the striker from moving along the latching axis out of the channel; and a linkage interconnecting the paddle handle and the catch such that the paddle handle operates to move the catch from the closed position to the open position;

wherein the linkage comprises a strut mounted for axial movement in the frame and mounted at one end on the paddle handle and at the other end on the catch;

wherein the strut is movable in the catch such that the catch can move from the closed to the open position without axially shifting the strut in the frame.

13. The invention of claim 12 wherein the catch presents a first, sloping face to the striker as the striker enters the channel such that the striker pushes the catch aside as the striker enters the channel, and the catch presents a second, transverse face to the striker as the striker moves out of the channel.

14. The invention of claim 13 further comprising a spring interposed between the frame and the catch to bias the catch to the closed position.

15. The invention of claim 13 wherein the transverse face comprises two face portions axially offset along the latching axis to provide primary and secondary latching positions.

16. A paddle handle latch configured for use with a striker mounted for movement toward and away from the latch along an opening/closing axis, said latch comprising:

a frame having a perimeter flange and defining a recess internal of the flange;

a paddle handle mounted to the frame for pivotal movement in the recess;

means for mounting the flange to a support panel;

a retainer mounted to define a channel having a latching axis, said retainer shaped to receive the striker when the latching axis is aligned with the opening/closing axis, and said retainer shaped to retain the striker against movement transverse to the latching axis;

a catch mounted in the retainer to move between an open position, in which the catch allows the striker to move along the latching axis in and out of the channel, and a closed position, in which the catch prevents the striker from moving along the latching axis out of the channel;

a linkage interconnecting the paddle handle and the catch such that the paddle handle operates to move the catch from the closed position to the open position; and a lock bar positioned to be movable in the retainer between a locked position, in which the lock bar passes through the striker, and an unlocked position, in which the lock bar is removed from the channel.

17. The invention of claim 1 wherein the perimeter flange defines a plane, and wherein the latching axis is substantially parallel to the plane.

18. The invention of claim 1 wherein the retainer comprises an element positioned to retain the striker against movement away from the frame.

* * * * *